US005336104A

United States Patent [19]

Nagamine

[11] Patent Number: 5,336,104

[45] Date of Patent: Aug. 9, 1994

[54] CONNECTOR

[75] Inventor: Akira Nagamine, Kawasaki, Japan

[73] Assignee: The Whitaker Corporation, Wilmington, Del.

[21] Appl. No.: 18,670

[22] Filed: Feb. 17, 1993

[30] Foreign Application Priority Data

Mar. 6, 1992 [JP] Japan ..... 4-011329[U]

[51] Int. Cl.[5] ..... H01R 13/627

[52] U.S. Cl. ..... 439/364; 439/489; 411/8; 403/27

[58] Field of Search ..... 439/359, 364, 365, 488, 439/489; 411/8, 14; 403/27, 343

[56] References Cited

U.S. PATENT DOCUMENTS 4,015,888 4/1977 Draper et al. ..... 439/489 X 5,228,867 7/1993 Nagamine ..... 439/364

*Primary Examiner*—Khiem Nguyen

*Attorney, Agent, or Firm*—Timothy J. Aberle

[57] ABSTRACT

An electrical connector (10) includes a plug housing (3) and a cap housing (7). A bolt housing (1) is provided with a bolt (5) therethrough for tightening the connector (10). The bolt housing has a mechanism (9) for indicating coupling completeness through a window (1c). In this way coupling completeness may be assured by the operator.

26 Claims, 5 Drawing Sheets

Fig. 1
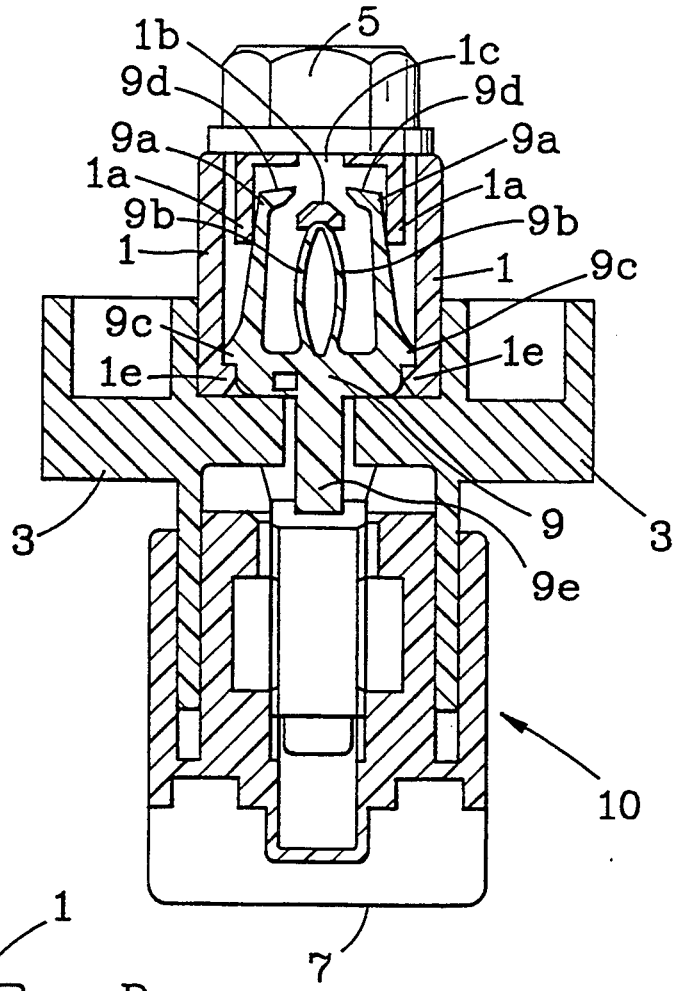
Fig. 2
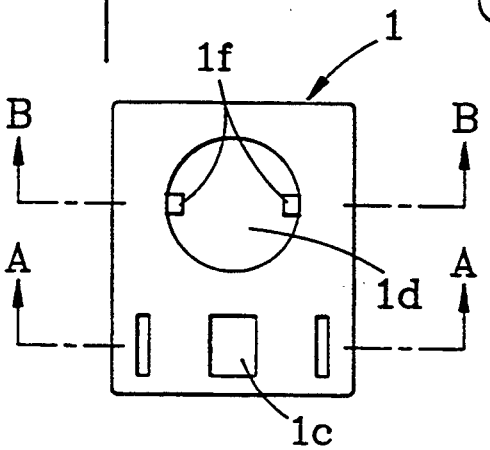
Fig. 4
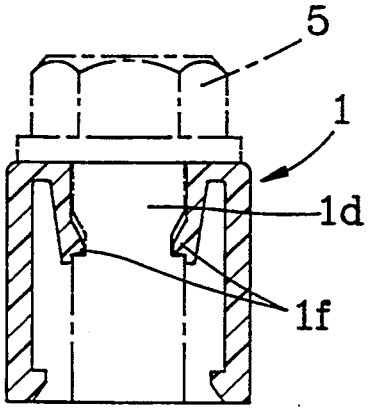
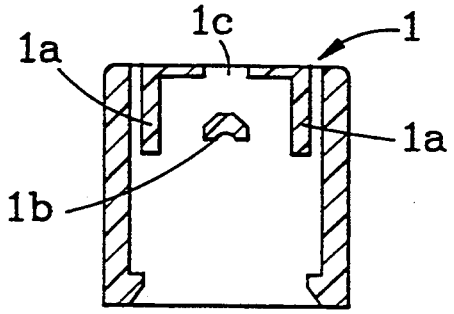
Fig. 3

Fig. 6
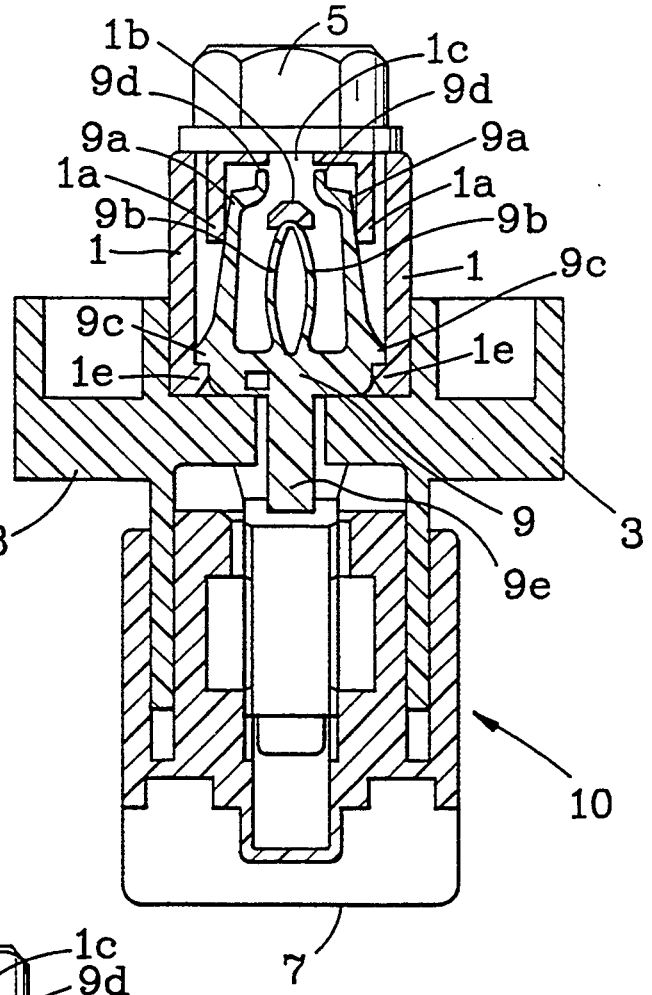
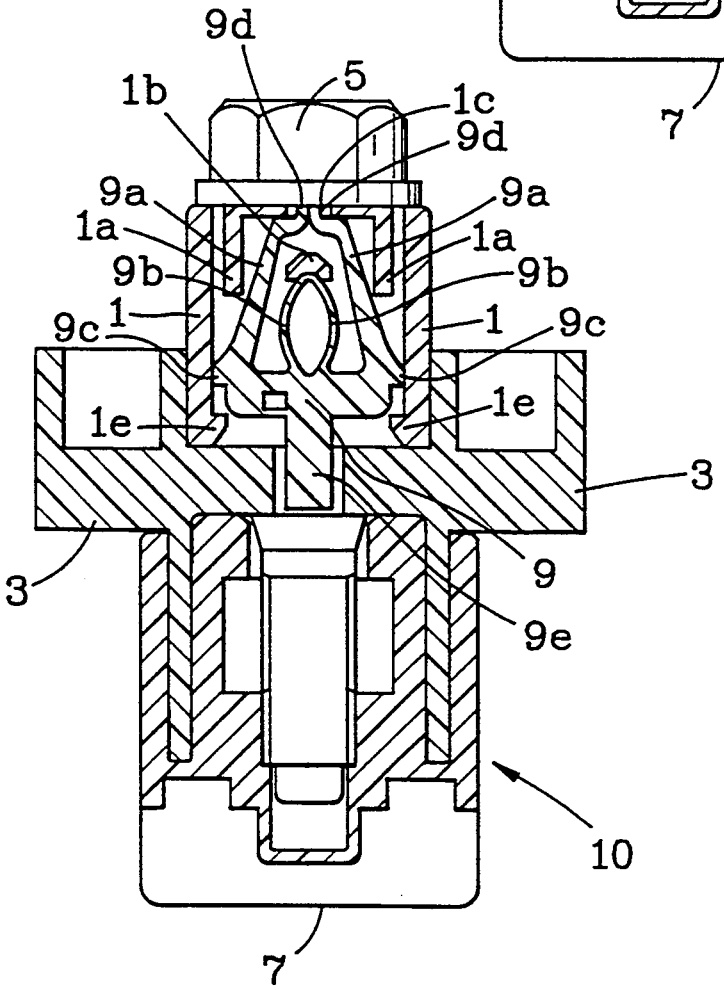
Fig. 7

(PRIOR ART)
Fig. 8
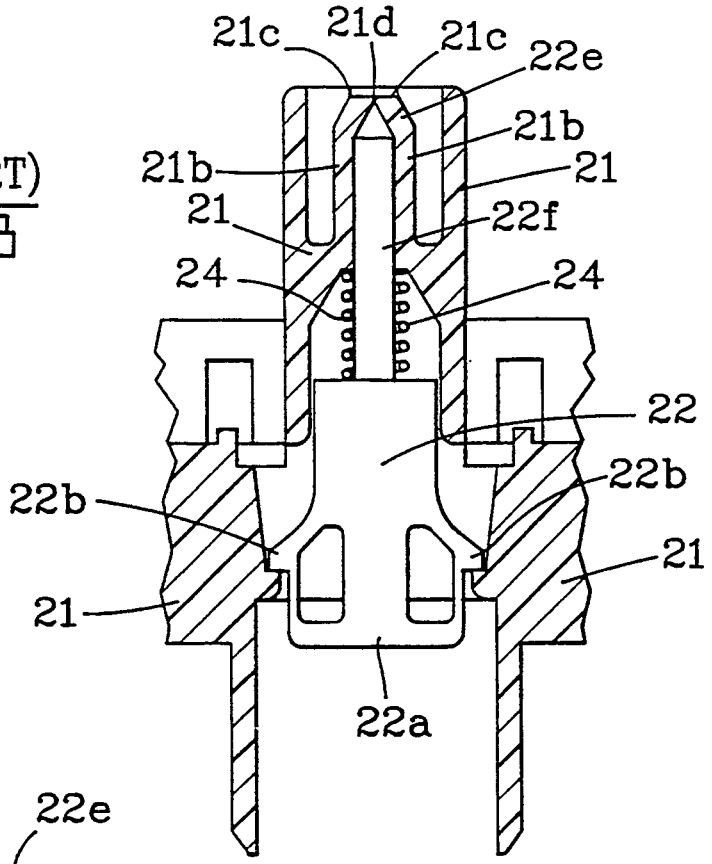
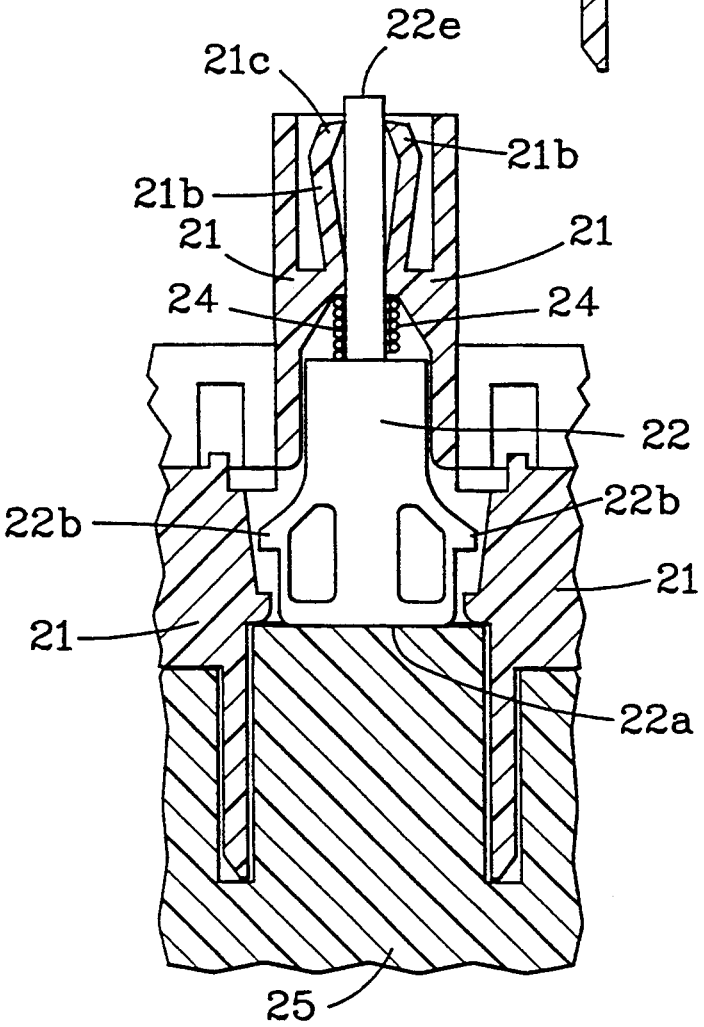
(PRIOR ART)
Fig. 9

CONNECTOR

This invention relates to a connector assembly for an electrical connector housing whose coupling completion can be visually confirmed.

BACKGROUND OF THE INVENTION

Various types of connectors are widely used for connecting electrical and electronic circuits. When a pair of connector housings that forms a connector are coupled, there are cases where the coupling is incomplete even though they are coupled and electrically connected, in which cases the coupling may come apart and break the electrical connection, and may even lead to a dangerous situation. Therefore, what is needed is a connector whose coupling completeness can be confirmed by the operator at the point in time when it is coupled.

Japanese Patent Application 60-1774, as shown in prior art FIGS. 8 and 9, is directed to a visible coupling complete indicator. FIG. 8 is a cross-sectional view showing the pre-coupling status of one connector housing. As shown in FIG. 8, coupling complete indicator member 22's projection 22*b* is held in one connector housing 21, coupling complete indicator member 22 is pressed by spring 24, and coupling complete indicator member 22's rod-shaped member 22*f* is supported by arm 21*b*. As shown in FIG. 8, arm 21*b*'s front end 21*c* has a narrowed shape that surrounds the front end of rod-shaped member 22*f*. Prior art FIG. 9 is a cross-sectional view showing the connector housing with the coupling in a completed state. As shown in FIG. 9, when another connector housing 25 is coupled with connector housing 21, connector housing 25 opposes the pressure of spring 24, and bottom 22*a* of coupling complete indicator member 22 is pushed upward, so coupling complete indicator member 22's rod-shaped member 22*f* opens connector housings 21's front end 21*c* and moves through that opening, and rod-shaped member 22*f*'s front end 22*e* projects outside connector housing 21. This front end 22*e* has a color that differs from that of connector housing 21, for example, and complete coupling can be confirmed by looking at this front end 22*e*.

The prior technology of Japanese Utility Application 61-197672, as shown in FIGS. 10 and 11, is also concerned with the same sort of object. In connector housing 30 shown in FIG. 10, coupling complete indicator member 32's projection 32*b* is held in main body unit 33, and coupling complete indicator member 32's compressible front end 32*e* is inserted in hole 34*d* in indicator unit 34, and coupling complete indicator member 32 is pressed by spring 31 and is supported between connector housing 30's main body unit 33 and indicator unit 34.

In prior art FIG. 11, connector housing 33 is coupled with another connector housing 35, and this connector housing 35 opposes the pressure of spring 31, and pushes up bottom 32*a* of coupling complete indicator member 32. When coupled, coupling complete indicator member 32's front end 32*e* compresses and passes through hole 34*d*, and front end 32*e* projects outside indicator unit 34. The connector's coupling completeness can be confirmed by looking at this projection.

The two conventional technologies noted above have problems. With the conventional example shown in prior art FIGS. 8 and 9, even though arm 21*b*'s front end 21*c* narrows, there are cases where gap 21*d* occurs, and even when the coupling is imperfect and coupling complete indicator member 22's front end 22*e* doesn't project outside, or the operator can see coupling complete indicator member 22's front end 22*e* through gap 21*d* and mistakenly decide the coupling is complete. Additionally, with the conventional example shown in prior art FIGS. 10–11, providing hole 34*d* further increases the possibility of an incomplete coupling situation.

In view of the above-noted circumstances, the object of this invention is to present a connector in which the operator can visually confirm the completion of the coupling of the connector housing without error.

SUMMARY OF THE INVENTION

In order to achieve the above-noted object, the instant connector is characterized by providing a pair of mutually coupling connector housings, and attaching a flexible arm for indicating coupling completion which is disposed in one of the pair of connector housings. Additionally, a coupling complete indicator window opening is formed through the inner wall and outer wall of the connector housing. Also, an engaging protrusion is formed on the inner wall to engage the flexible arm when coupling and elastically deforming the flexible arm to reach a position visible through the coupling complete indicator window from a position outside the coupling complete indicator window when coupling is complete.

The invention's connector has the above-noted coupling complete indicator window, and when coupled the above-noted engaging protrusion engages with the flexible arm, and the flexible arm is arranged such that it is elastically deformed to reach a position visible through the coupling complete indicator window from a position outside the coupling complete indicator window when coupling is complete. The operator, therefore, cannot see the flexible arm when coupling is incomplete, and the operator can visually confirm the flexible are through the coupling complete indicator window only when coupling is complete. In this way the connector housing's complete coupling can be visually confirmed with confidence and without error. Moreover, the instant invention uses the elasticity of the coupling complete indicator member, so the separate spring member in conventional technology is not required, and the number of parts is reduced and assembly costs are lowered.

BRIEF DESCRIPTION OF THE DRAWINGS

FIG. 1 is a cross-sectional view of one embodiment of the invention showing the coupling status before coupling completion.

FIG. 2 is a plan view of the bolt housing shown in FIG. 1.

FIG. 3 is a cross-sectional view of the bolt housing of FIG. 1 taken along line A—A.

FIG. 4 is a cross-sectional view of the bolt housing of FIG. 1 taken along line B—B.

FIG. 6 is a cross-sectional view of a second embodiment of the invention before coupling completion.

FIG. 7 is a cross-sectional view of a second embodiment of the invention after coupling completion.

FIG. 8 is a cross-sectional view of a conventional connector.

FIG. 9 is a cross sectional view of the connector of FIG. 8 after coupling completion.

DESCRIPTION OF THE PREFERRED EMBODIMENT(S)

Figure 5:
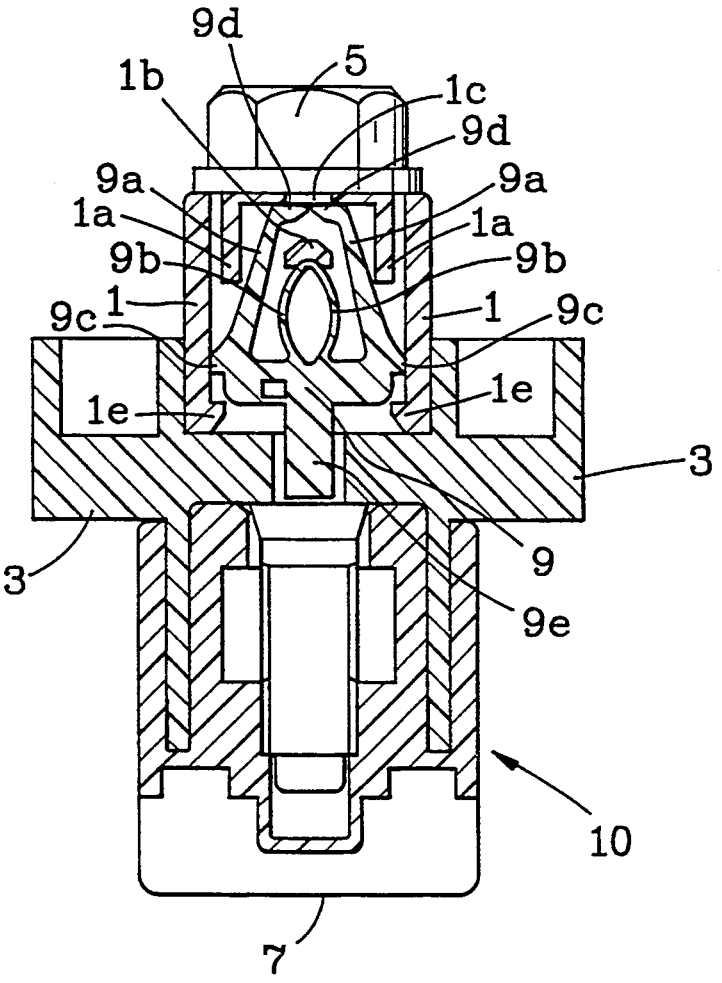
FIG. 5 is a cross-sectional view the embodiment of FIG. 1 showing the coupling status after coupling completion.
Figure 10:
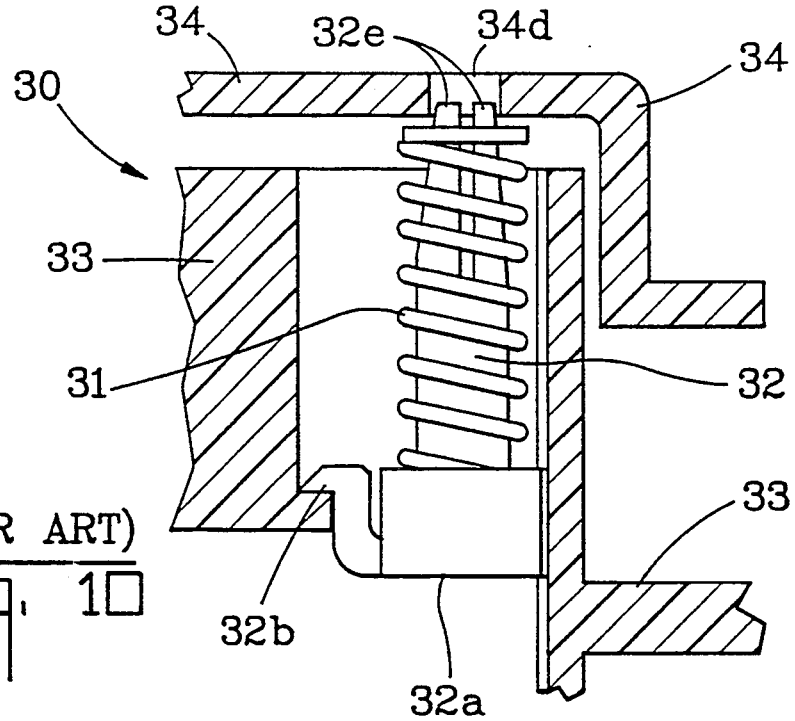
(PRIOR ART) Fig. 10
FIG. 10 is a cross-sectional view of a conventional connector.
Figure 11:
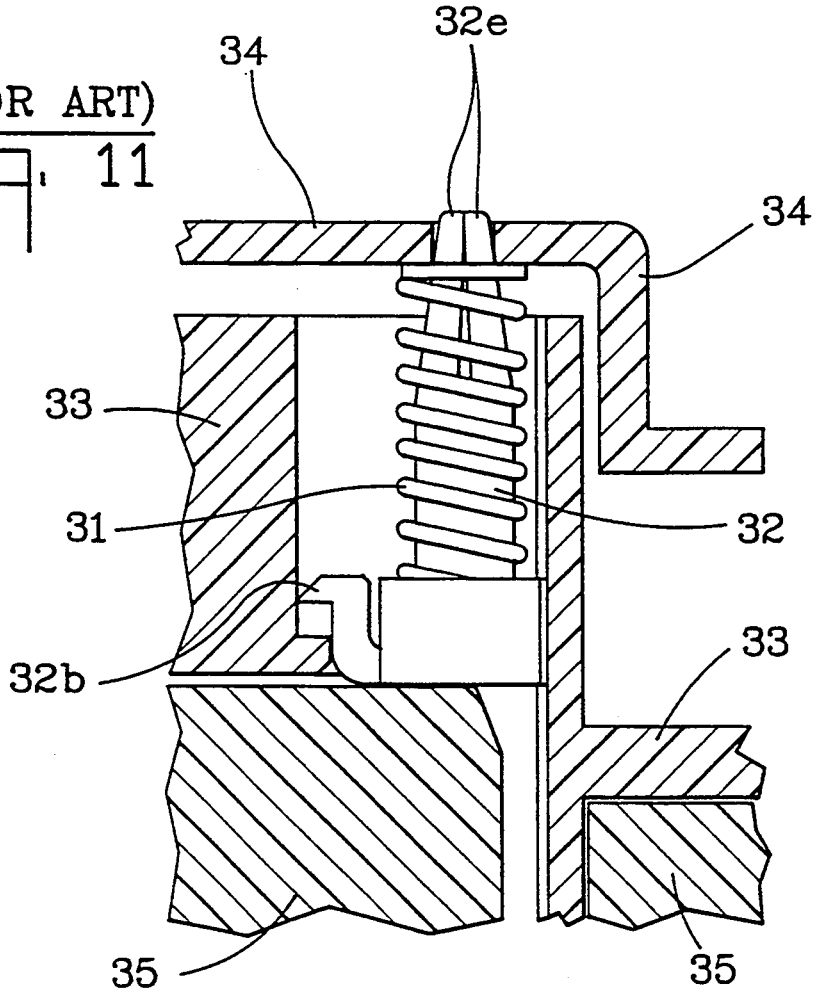
(PRIOR ART) Fig. 11
FIG. 11 is a cross sectional view of the connector of FIG. 10 after coupling completion.

FIG. 1 is a cross-sectional view showing one embodiment of the invention before coupling completion. FIG. 1 shows cap housing 7 imperfectly coupled in a distal position relative to bolt housing 1 and plug housing 3, which altogether form a unitary housing.

Coupling complete indicator member 9's flexible cantilever spring arm 9*a* engages with protrusion 1*a* formed on the inner wall of a cavity in bolt housing 1, and elliptical spring member 9*b* contacts contact member 1*b* projecting from the inner wall of bolt housing 1. Further, holding unit or projection 9*c* is held by bolt housing 1's projection 1*e*, and thus coupling complete indicator member 9 is supported by bolt housing 1. It is seen that coupling complete indicator member 9 is pressed downward in FIG. 1 by the engagement of bolt housing 1's protrusion la and contact member 1*b*. Additionally, bolt or joining mechanism 5 is inserted through bolt hole 1*d* (see FIG. 2) in bolt housing 1, and plug housing 3 is fitted onto bolt 5. Further, a unitary housing is formed from bolt housing 1 and plug housing 3.

FIG. 2 is a top view of bolt housing 1 shown in FIG. 1, FIG. 3 is a cross-section view along A—A in FIG. 2, and FIG. 4 is a cross-section view along B—B in FIG. 2. Referring to FIG. 2, coupling complete indicator window 1*c* is provided in the top of bolt housing 1 in order to confirm the complete coupling of connector housings 3 and 7. The cross-sectional view shown in FIG. 3 has protrusion 1*a*, which engages with coupling complete indicator member 9's flexible arm 9*a* (see FIG. 1), and contact member 1*b*, which contacts elliptical or O-shaped spring member 9*b*, around coupling complete indicator window 1*c* for confirming complete coupling. Additionally, the cross-sectional view shown in FIG. 4 has bolt hole 1*d* with bolt 5 inserted and bolt support protrusion 1*f*, which engages with bolt 5's notch.

FIG. 5 is a cross-sectional view of the embodiment in FIG. 1, but with the plug housing 3 and the cap housing 7 in a relatively proximal position, such that cap housing 7 is perfectly coupled with plug housing 3 (including bolt housing 1). Plug housing 3 has a plurality of electrical contacts (not shown) for mating engagement with electrical contacts in cap housing 7. Plug housing 3 and cap housing 7 are coupled by tightening bolt 5. Specifically, cap housing 7 presses upward on coupling complete indicator member 9 at downward projection 9*e*, as shown in FIG. 5, thereby displacing the coupling complete member 9, and thus flexible arm 9*a* is bent toward coupling complete indicator window 1*c* by protrusion 1*a*. Then, when coupling is complete, flexible arm 9*a*'s tip 9*d* reaches the position of coupling complete indicator window 1*c*, and for the first time flexible ar 9*a* can be seen through coupling complete indicator window 1*c*. Further, a gap is formed between the coupling complete member 9 and the plug housing 3, and a gap is formed between the plug housing 3, holding unit 9*c*, and projection 1*e*. The coupling complete indicator member 9 has a color which is obviously different from the housing, so that by looking at this the operator can confidently confirm that the connector housing's coupling is complete.

FIGS. 6 and 7 are cross-sectional views of a second embodiment of this invention showing the start of coupling (FIG. 6), and complete coupling (FIG. 7.) In these Figures the same numbers are assigned to the same structural elements as in FIGS. 1–5 (see FIGS. 1–5), so that duplicate explanations are omitted. In this embodiment, as shown in FIG. 7, coupling complete indicator member 9's flexible arm 9*a*'s tip 9*d* faces upward. When plug housing 3 and cap housing 7 are coupled from a relatively distal to proximal position by tightening bolt 5, coupling complete indicator member 9 is pushed upward, and thus flexible arm 9*a* engages with protrusion 1*a* and bends toward coupling complete indicator window 1*c*. Then, when coupling is complete, flexible arm 9*a*'s tip 9*d*' is inserted into coupling complete indicator window 1*c*. In this way, the operator can visually confirm with all the more clarity that coupling is complete.

Furthermore, coupling complete indicator member 9 has elliptical spring member 9*b* in the above-noted embodiments, but flexible arm 9*a* itself has springiness, so elliptical spring member 9*b* can be eliminated by providing flexible arm 9*a* with appropriate elasticity. Moreover, each of the above-noted embodiments is furnished with a pair of flexible arms 9*a*, but there could also be a single or a plurality of flexible arms.

Finally, each of the above-noted embodiments is an example of this invention using a bolt-tightening type of connector, but this invention is not limited to a bolt-tightening type of connector, as it can be adopted in many types of connectors.

I claim:

1. An electrical connector assembly comprising:

a plug housing including a plurality of electrical contacts;

a cap housing having a plurality of electrical contacts for mating with the contacts of the plug housing;

a housing joining mechanism which cooperates with the cap and plug housings for joining the housings together from a first, distal position to a second, proximal position;

a bolt housing with a cavity therein, said bolt housing further includes a coupling-complete member with two cantilever spring arms disposed in said cavity, and a window formed in a top side of the bolt housing for view a portion of said cantilever spring arm; and wherein said coupling-complete member includes a base portion, said cantilever spring arms and a spring member being integrally formed on said base portion, said spring member is formed between said cantilever spring arms and extends upwardly from said base portion;

whereby upon activation of said joining mechanism the housings move closer together and the cantilever spring arms bend and become visible at the window thereby indicating complete coupling of the electrical contacts when said housings are in said proximal position.

2. The electrical connector of claim 1, wherein a bottom surface of the coupling-complete member engages a surface of said plug housing when said housings are in said distal position.

3. The electrical connector of claim 2, wherein a side surface of the coupling-complete member includes an outwardly extending projection which engages a projection formed on an inside surface of said bolt housing when said housing are in said distal position.

4. The electrical connector of claim 1, wherein a gap is formed between a bottom surface of the coupling-complete member a top surface of said plug housing when said housing are in said proximal position.

5. The electrical connector of claim 4, wherein a side surface of the coupling-complete member includes an outwardly extending projection which forms a gap between said projection and a projection formed on an inside surface of said bolt housing when said housings are in said proximal position.

6. The electrical connector of claim 1, wherein a bottom surface of the coupling-complete member includes a downwardly extending displacement means for displacing said coupling-complete member from a lower to an upper position.

7. The electrical connector of claim 6, wherein said downwardly extending displacement means comprises a projection which protrudes into an opening in the plug housing and engages the cap housing in said proximal position.

8. The electrical connector of claim 1, wherein a side surface of the coupling-complete member includes an outwardly extending projection which engages the bolt housing.

9. The electrical connector of claim 8, wherein said coupling-complete member cantilever spring arm engages at least one downwardly extending projection formed in said cavity of said bolt housing.

10. The electrical connector of claim 8, wherein said coupling-complete member includes at least one upwardly extending, generally O-shaped spring member which resiliently engages a fixed projection formed on said bolt housing.

11. The electrical connector of claim 1, wherein said coupling-complete member includes at least one upwardly extending, generally O-shaped spring member which resiliently engages a fixed projection formed in said cavity of said bolt housing.

12. The electrical connector of claim 1, wherein said coupling-complete member cantilever spring arm engages at least one downwardly extending projection formed on said bolt housing.

13. The electrical connector of claim 1, wherein said coupling-complete member includes at least two cantilever spring arms which each engage a downwardly extending projection formed on said bolt housing.

14. The electrical connector of claim 1, wherein said coupling-complete member includes at least two upwardly extending cantilever spring arms each including a tip end which engages respective edges of said window when said housings are in said proximal position.

15. An electrical connector assembly comprising:

a plug housing including a plurality of electrical contacts;

a cap housing having a plurality of electrical contacts for mating with the contacts of the plug housing;

a housing joining mechanism which cooperates with the cap and plug housings for joining the housings together from a first, distal position to a second, proximal position;

a bolt housing with a cavity therein, said bolt housing further includes a coupling-complete member with at least one cantilever spring arm disposed in said cavity, and a window formed in a top side of the bolt housing for viewing a portion of said cantilever spring arm;

a side surface of the coupling-complete member includes an outwardly extending projection which engages the bolt housing, and said coupling-complete member cantilever spring arm engages at least one downwardly extending projection formed in said cavity of said bolt housing, whereby upon activation of said joining mechanism the housings move closer together and the cantilever spring arm bends and becomes visible at the window thereby indicating complete coupling of the electrical contacts when said housings are in said proximal position.

16. The electrical connector of claim 15, wherein a bottom surface of the coupling-complete member engages a surface of said plug housing when said housings are in said distal position.

17. The electrical connector of claim 16, wherein said outwardly extending projecting engages a projection formed on an inside surface of said bolt housing when said housings are in said distal position.

18. The electrical connector of claim 15, wherein a gap is formed between a bottom surface of the coupling-complete member a top surface of said plug housing when said housings are in said proximal position.

19. The electrical connector of claim 18, wherein said outwardly extending projection forms a gap between said projection and a projection formed on an inside surface of said bolt housing when said housings are in said proximal position.

20. The electrical connector of claim 15, wherein a bottom surface of the coupling-complete member includes a downwardly extending displacement means for displacing said coupling-complete member from a lower to an upper position.

21. The electrical connector of claim 20, wherein said downwardly extending displacement means comprises a projection which protrudes into an opening in the plug housing and engages the cap housing in said proximal position.

22. The electrical connector of claim 15, wherein said coupling-complete member includes at least one upwardly extending, generally O-shaped spring member which resiliently engages a fixed projection formed on said bolt housing.

23. The electrical connector of claim 15, wherein said coupling-complete member includes at least one upwardly extending generally O-shaped spring member which resiliently engages a fixed projection formed in said cavity of said bolt housing.

24. The electrical connector of claims 15, wherein said coupling-complete member cantilever spring arm engages at least one downwardly extending projection formed on said bolt housing.

25. The electrical connector of claim 15, wherein said coupling-complete member includes at least two cantilever spring arms which each engage a respective downwardly extending projection formed on said bolt housing.

26. The electrical connector of claim 15, wherein said coupling-complete member includes at least two upwardly extending cantilever spring arms each including a tip end which engages respective edges of said window when said housings are in said proximal position.

* * * * *

UNITED STATES PATENT AND TRADEMARK OFFICE

CERTIFICATE OF CORRECTION

PATENT NO. : 5,336,104

DATED : August 9, 1994

INVENTOR(S) : Akira Nagamine

It is certified that error appears in the above-indentified patent and that said Letters Patent is hereby corrected as shown below:

Column 4,

Claim 1, line 48, "view" should be --viewing--.

Column 5,

Claim 4, line 6, "housing" should be --housings--.

Column 6,

Claim 17, line 20, "projecting" should be --projection--.

Signed and Sealed this

Eighteenth Day of October, 1994

Bruce Lehman

*Attest:*

BRUCE LEHMAN

*Attesting Officer*

*Commissioner of Patents and Trademarks*